US005425175A

United States Patent [19]

Rogers

[11] Patent Number: 5,425,175

[45] Date of Patent: Jun. 20, 1995

[54] KNIFE WITH MULTIPLE CUTTING POSITIONS

[76] Inventor: Carl E. Rogers, 12005 Lake Lery Ave., Baton Rouge, La. 70816

[21] Appl. No.: 264,312

[22] Filed: Jun. 23, 1994

Related U.S. Application Data

[63] Continuation-in-part of Ser. No. 57,255, May 4, 1993, Pat. No. 5,325,588.

[51] Int. Cl.[6] ..... B26B 1/04

[52] U.S. Cl. ..... 30/161; 30/155

[58] Field of Search ..... 30/161, 160, 159, 158, 30/155, 151

[56] References Cited

U.S. PATENT DOCUMENTS

| | | | |
|---|---|---|---|
| 292,473 | 1/1984 | Dieterich et al. | 30/161 |
| 512,965 | 1/1994 | Hoyez | 30/161 |
| 1,469,957 | 10/1923 | Rich . | |
| 2,651,106 | 9/1953 | Breitzke | 30/125 |
| 2,651,839 | 9/1953 | Folland | 30/125 |
| 2,681,505 | 6/1954 | Flanagan | 30/125 |
| 3,783,509 | 1/1974 | Lake | 30/161 |
| 4,233,737 | 11/1980 | Poehlmann | 30/335 |
| 4,425,709 | 1/1984 | Quenzi | 30/151 |
| 4,730,394 | 3/1988 | Sonner, Jr. | 30/161 |
| 4,893,409 | 1/1990 | Poehlmann | 30/161 |
| 5,125,157 | 6/1992 | Howard | 30/123 |
| 5,325,588 | 7/1994 | Rogers | 30/161 |

*Primary Examiner*—Hwei Siu Payer

*Attorney, Agent, or Firm*—Robert C. Tucker; William David Kiesel; Russel O. Primeaux

[57] ABSTRACT

A knife having angularly adjustable cutting positions is provided, comprising a blade having a base portion, the base portion having an outer edge including an engagement portion including a positioning mechanism for positioning the blade in multiple angular cutting positions with reference to a handle; a handle including a biased locking member for selectively engaging the positioning mechanism and fixing the blade in each of the angular cutting positions, the handle having a blade end; a spring, positioned in the handle, for biasing the locking member against the positioning mechanism; and wherein the base portion of the blade is pivotally attached to the blade end of the handle at a pivot point located within the blade end.

15 Claims, 6 Drawing Sheets

KNIFE WITH MULTIPLE CUTTING POSITIONS

CONTINUATION DATA

This is a continuation-in-part of patent application Ser. No. 08/057,255, filed on May 4, 1993, now U.S. Pat. No. 5,325,588.

BACKGROUND OF THE INVENTION

1. Field of the Invention

This invention relates generally to knives and, more particularly, to knives having multiple angular cutting positions.

2. Prior Art

In some applications it is desirable to use knives with different angular cutting positions. For example, when hunting it is desirable to use a knife having an angle between the cutting portion of the blade and the handle of slightly less than 180 degrees for field dressing an animal. It is also desirable to use a knife having an angle between the cutting portion of the blade and the handle of slightly greater than 180 degrees for skinning an animal. Prior to the invention disclosed herein, sportsmen often carried two specialized knives to accomplish these two tasks. Of course, the extra bulk and expense of the dual knife system is undesirable, particularly under rugged hunting conditions.

In order to address the need for adjustable blades, prior art knife designs have resorted to interchangeable blades, or to adjustable knives with relatively complex adjustment mechanisms requiring the removal of wing nuts and the like for adjustment or replacement of the blade. Again, in outdoor applications, such mechanisms are undesirable due to the possibility of losing knife parts as well as the difficulty encountered in adjusting the angle of the blade. As a result, most hunters desiring knives having field dressing, skinning or other specialized angular positions continue to carry multiple fixed blade knives in multiple scabbards or multiple folding knives.

SUMMARY OF THE INVENTION

It is therefore an object of this invention to provide a single blade knife having a blade which is easily and quickly adjustable between a plurality of curing positions.

It is another object of this invention to provide a single blade knife having multiple cutting positions which does not require the removal of any hardware to adjust the knife between cutting positions.

It is yet another object of this invention to provide a single blade knife having multiple cutting positions, and which also adjusts to a folded, or closed, position.

It is a further object of this invention to provide a single blade knife having multiple cutting positions which accomplishes various combinations or all of the above objects.

Accordingly, a knife having angularly adjustable cutting positions is provided, comprising a blade having a base portion, the base portion having an outer edge including an engagement portion including a positioning mechanism for positioning the blade in multiple angular cutting positions with reference to a handle; a handle including a biased locking member for selectively engaging the positioning mechanism and fixing the blade in each of the angular cutting positions, the handle having a blade end; a spring, positioned in the handle, for biasing the locking member against the positioning mechanism; and wherein the base portion of the blade is pivotally attached to the blade end of the handle at a pivot point located within the blade end.

Various embodiments of the knife are possible, including folding and non-folding versions as disclosed herein.

DETAILED DESCRIPTION OF PREFERRED EMBODIMENTS OF THE INVENTION

Figure 4:
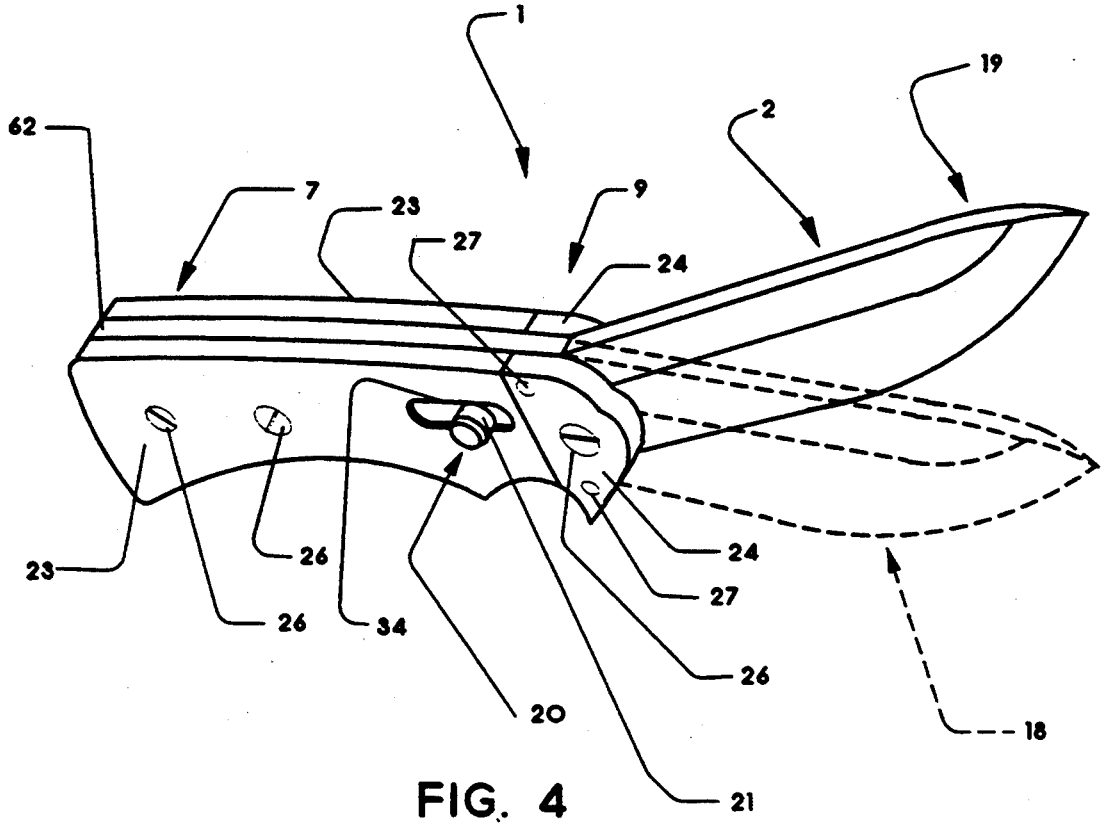
FIG. 4 is an assembled perspective view of the embodiment of the invention shown in FIGS. 1–3.
Figure 6:
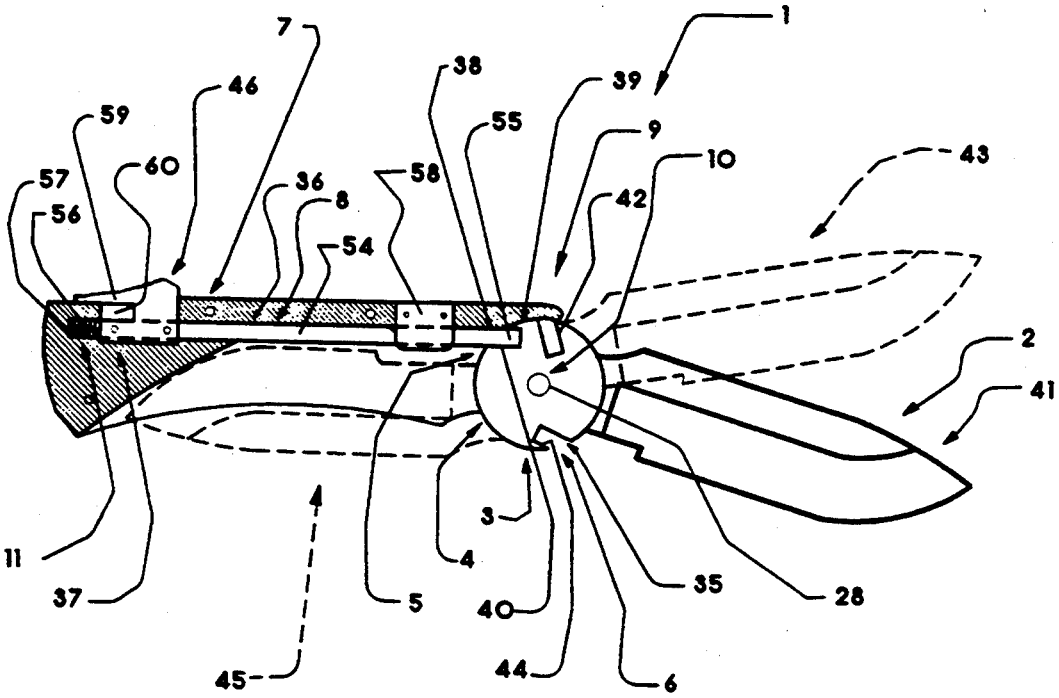
FIG. 6 is a sectional side view of an alternate folding embodiment of the invention.
Figure 5:
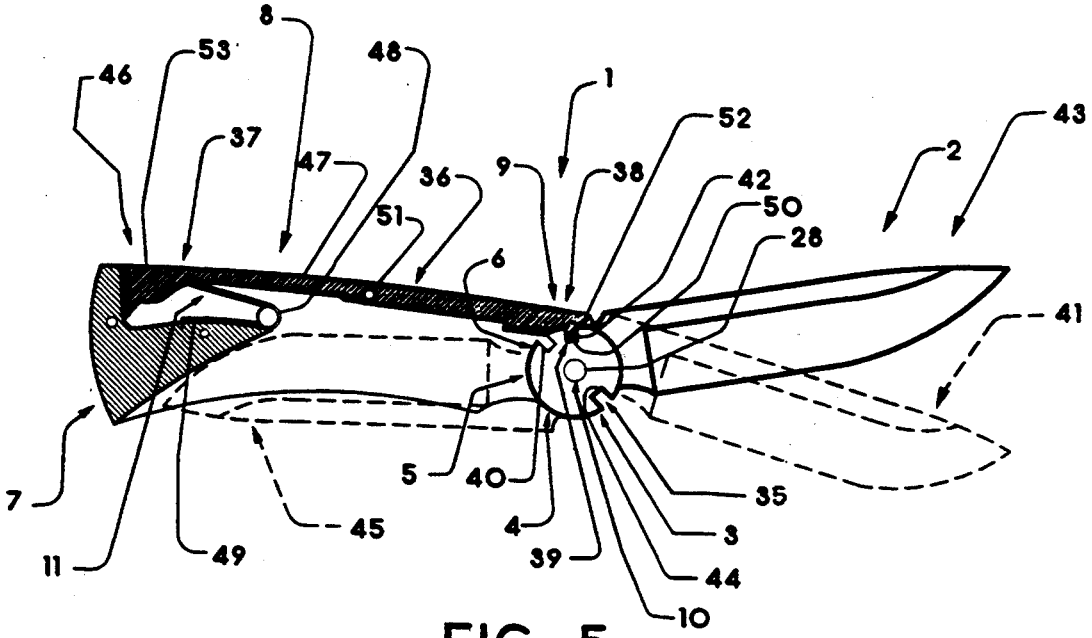
FIG. 5 is a sectional side view of a folding embodiment of the invention.

The invention, as shown in the Figures, comprises a knife 1 having a plurality of angularly adjustable cutting positions. The knife 1 includes a blade 2 having a base portion 3 having an outer edge 4 which further includes an engagement portion 5. Engagement portion 5 includes a positioning means 6 for positioning blade 2 in a plurality of angular cutting positions with reference to handle 7. Handle 7 includes a biased engagement means 8 for selectively engaging positioning means 6 and fixing blade 2 in each of the angular cutting positions. Handle 7 has a blade end 9, where base portion 3 of blade 2 is pivotally attached at pivot point 10 within base portion 3, as shown. A resilient means 11, for biasing engagement means 8 against positioning means 6, is positioned in handle 7. Various embodiments of the knife 1 are shown in the Figures. FIGS. 1–4 depict a non-folding version having two cutting positions. FIG. 5 depicts a version which can have a folded or closed position and two or more cutting positions. FIG. 6 depicts an alternate version which can also have a folded or closed position and two or more cutting positions. Each version will be explained in greater detail below.

Figure 1:
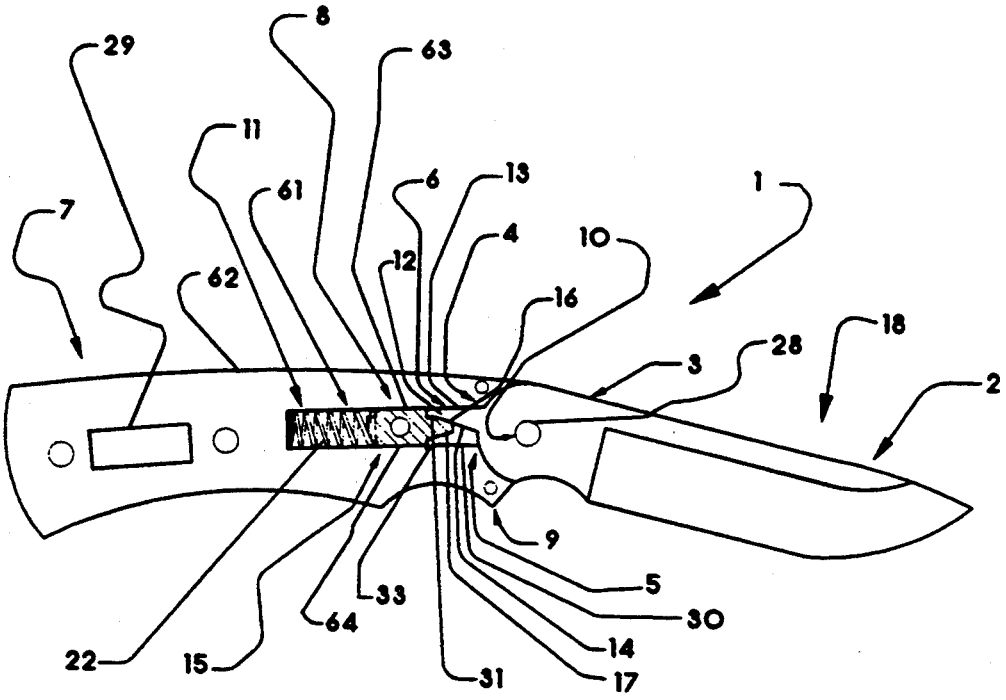
FIG. 1 is a sectional side view of an embodiment of the non-folding version of the invention in a first curing position.
Figure 2:
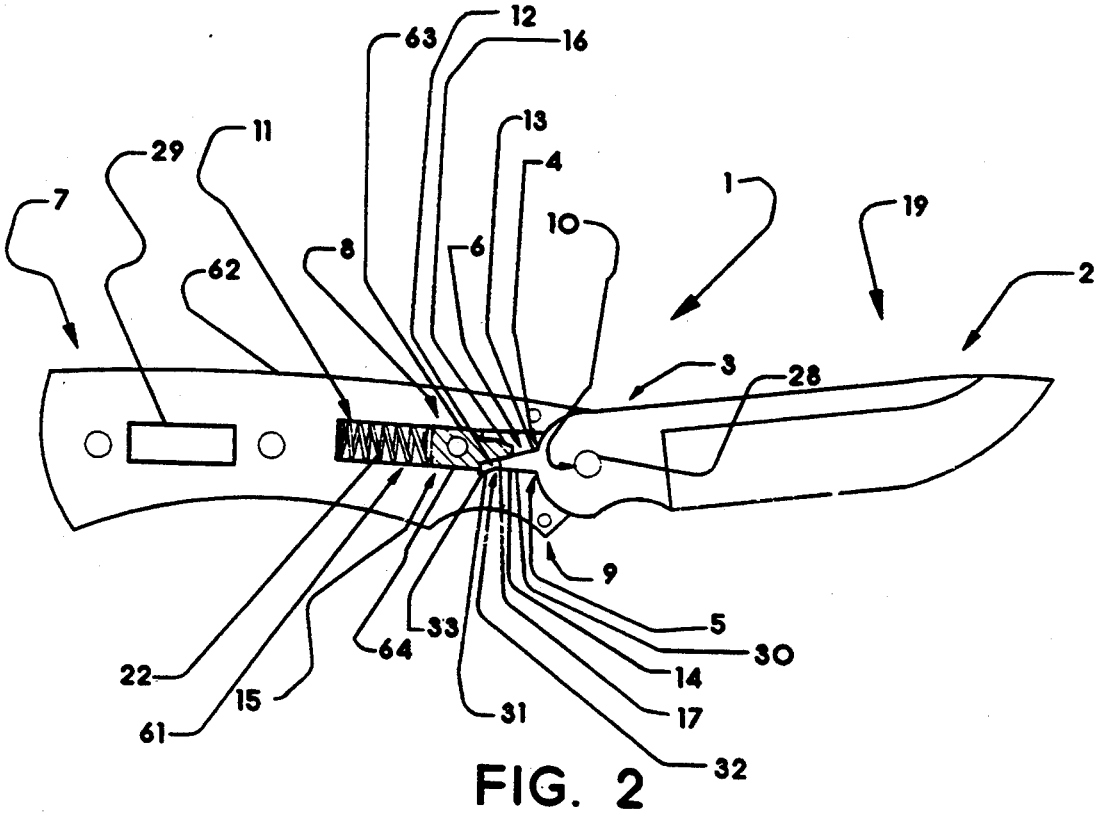
FIG. 2 is a sectional side view of the embodiment shown in FIG. 1 in a second curing position.

As shown in FIGS. 1 and 2, the non-folding version of the knife 1 includes a positioning means 6 comprising a tail portion 12 extending from base portion 3 of blade 2. Tail portion 12 includes an upper surface 13 and a lower surface 14. As shown in the FIG. 3, tail portion 12 is preferably the same approximate thickness as base portion 3 of blade 2. Engagement means 8 comprises a locking member 15 which is slidably positioned in handle 7 between resilient means 11 and base portion 3 of blade 2. Preferably, locking member 15 is approximately the same thickness as tail portion 12 and has an upper surface 16, which is matingly engageable, within a recess 61 in handle 7, with lower surface 14 of tail portion 12 in a first curing position 18, and a lower surface 17, which is matingly engageable with upper surface 13 of tail portion 12 in a second curing position 19. As shown, the positioning of tail portion 12 on base portion 3 and the angles of upper surface 16 and lower surface 17 determine the angular adjustment between first cutting position 18 and second cutting position 19. In first cutting position 18, tail portion 12 is fixed between upper surface 16 of locking member 15 and upper wail 63 of recess 61. In second cutting position 19, tail portion 12 is fixed between lower surface 17 of locking member 15 and lower wall 64 of recess 61. Preferably, lower surface 14 of tail portion 12 includes a primary segment 30 and an end segment 31, with primary segment 30 and said end segment 31 forming an obtuse angle 32, as shown in FIG. 2. This arrangement prevents blade 2 from moving from first cutting position 18 to second cutting position 19 without the user forcibly retracting locking member 15. It is preferable that a slight indentation 33 in lower wall 64 be formed so as to matingly receive end segment 31.

A means 20 is provided for retracting locking member 15 against resilient means 11 and away from engagement with tail portion 12 so as to allow blade 2 to be pivoted between first cutting position 18 and second cutting position 19. Means 20 preferably comprises an actuator member 21 connected to and extending outward from locking member 15 through actuator slot 34 in handle 7 to a point exterior of handle 7, as shown, such that locking member 15 may be operated with the thumb or other fingers.

Figure 3:
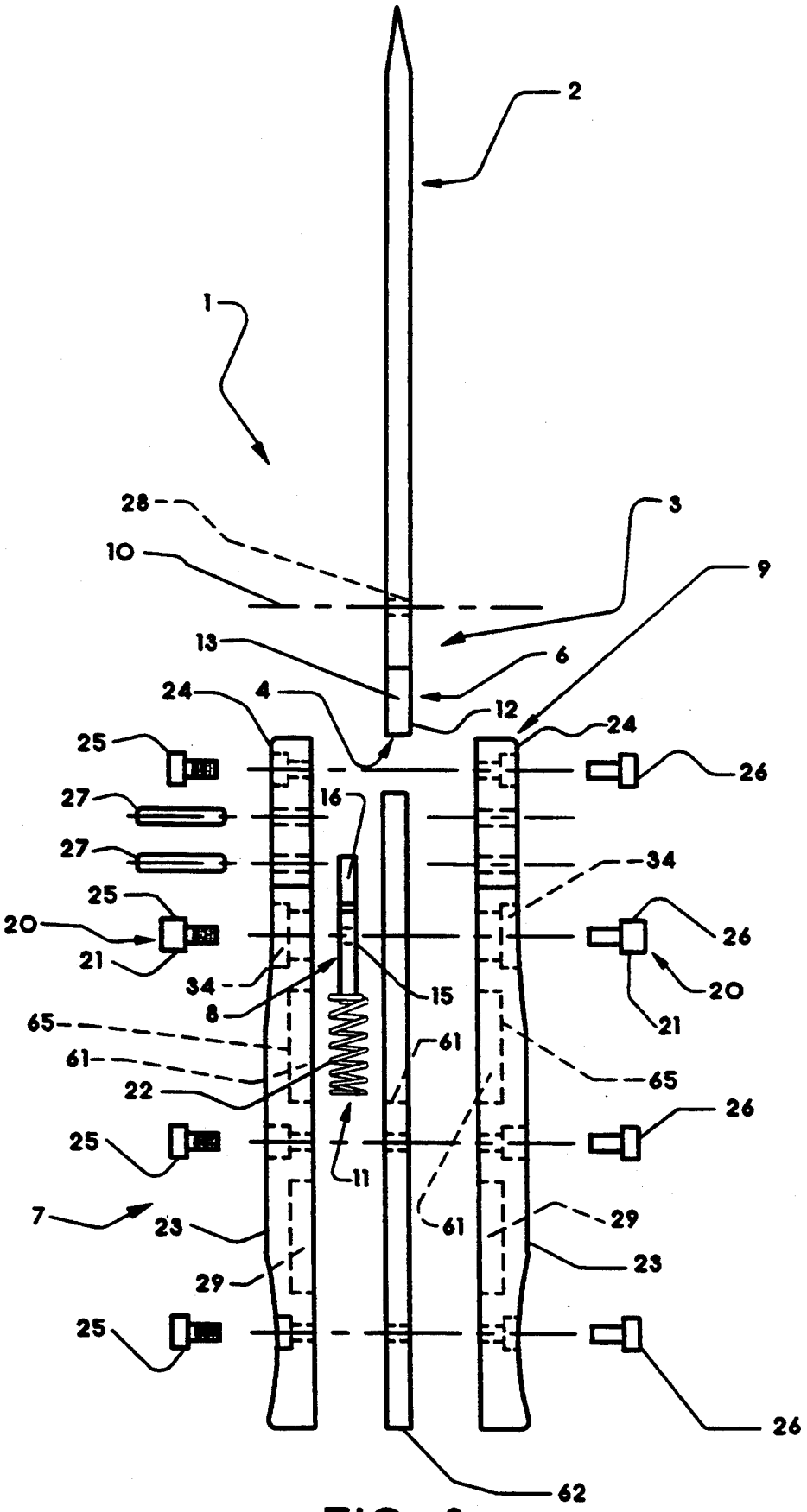
FIG. 3 is an exploded top view of the embodiment of the invention shown in FIGS. 1 and 2.

Resilient means 11 preferably comprises a spring 22, which is contained in an enclosed spring recess 65 in handle 7, as shown in FIG. 3, which forms a portion of recess 61. Tail portion 12 protrudes into recess 61 and into contact with locking member 15, which is interposed between spring 22 and said tail portion 12. Handle 7 may be constructed as known in the art, provided that the elements of the invention 1 are contained accordingly. As shown in FIGS. 3 and 4, handle 7 may include handle scales 23 and hilt plates 24, which contain spacer plate 62. Handle 7 is held together by bolts 25, nuts 26 and peening pins 27 as needed. One bolt 25 and nut 26 combination occupies pivot point 10 and passes through pivot hole 28 in base portion 3 of blade 2. A spare spring compartment 29 may be provided in handle 7, as shown.

The embodiments shown in FIGS. 5 and 6 may be used for folding and non-folding knives, and may include multiple cutting positions. Both embodiments include a positioning means 6 comprising a plurality of slots 35 spaced apart on outer edge 4 of base portion 3 of blade 2 and extending into base portion 3. Engagement means 8 comprises a locking member, generally denoted by 36, positioned in handle 7. Locking member 36 has a base end 37 and an engagement end 38. An engagement tab 39 extends from engagement end 38, and is selectively and matingly insertable into a first slot 40 in a first cutting position 41. Engagement tab 39 is also selectively and matingly insertable into a second slot 42 in a second cutting position 43. If a third slot 44 is provided, engagement tab 39 is selectively and matingly insertable into third slot 44 in a folded, or closed, position 45. Locking member 36 is positioned in handle 7 such that resilient means 11 is biased against locking member 36, urging engagement tab 39 against outer edge 4 of blade 2 and into one of the slots 40,42,44 when aligned therewith. Locking member 36 further comprises a means 46 for retracting locking member 36 against resilient means 11 and away from outer edge 4 so as to allow blade 2 to be pivoted between cutting positions 41,43 and/or closed position 45. Again, handle 7 may be constructed as known in the art, provided that the elements of the invention 1 are contained accordingly. Of course, additional cutting positions may be provided by adding more slots 35.

The particular embodiment shown in FIG. 5 utilizes a pivoting locking member 47, which is pivotally attached to handle 7 using a pin 51 or other means known in the art. Resilient means 11, preferably a spring 48, is interposed between a fixed point 49 on handle 7 and base end 37 of locking member 47 such that engagement tab 50, which preferably extends angularly from engagement end 38 toward pivot point 10, is pivotally urged against outer edge 4 of base portion 3 of blade 2 and into one of the slots 40,42,44 when aligned therewith. In the embodiment shown in FIG. 5, slots 40,42,44 are substantially radially spaced with reference to pivot point 10 so as to be alignable with engagement tab 50. A tip portion 52 may be added to extend from engagement end 38 to cover empty slot 42 when blade 2 is in first position 41. Means 46 for retracting locking member 47 includes an exposed portion 53 of base end 37 of locking member 47 exposed exterior of handle 7 so as to enable base end 37 to be urged against resilient means 11, thus disengaging tab 50.

Figure 7:
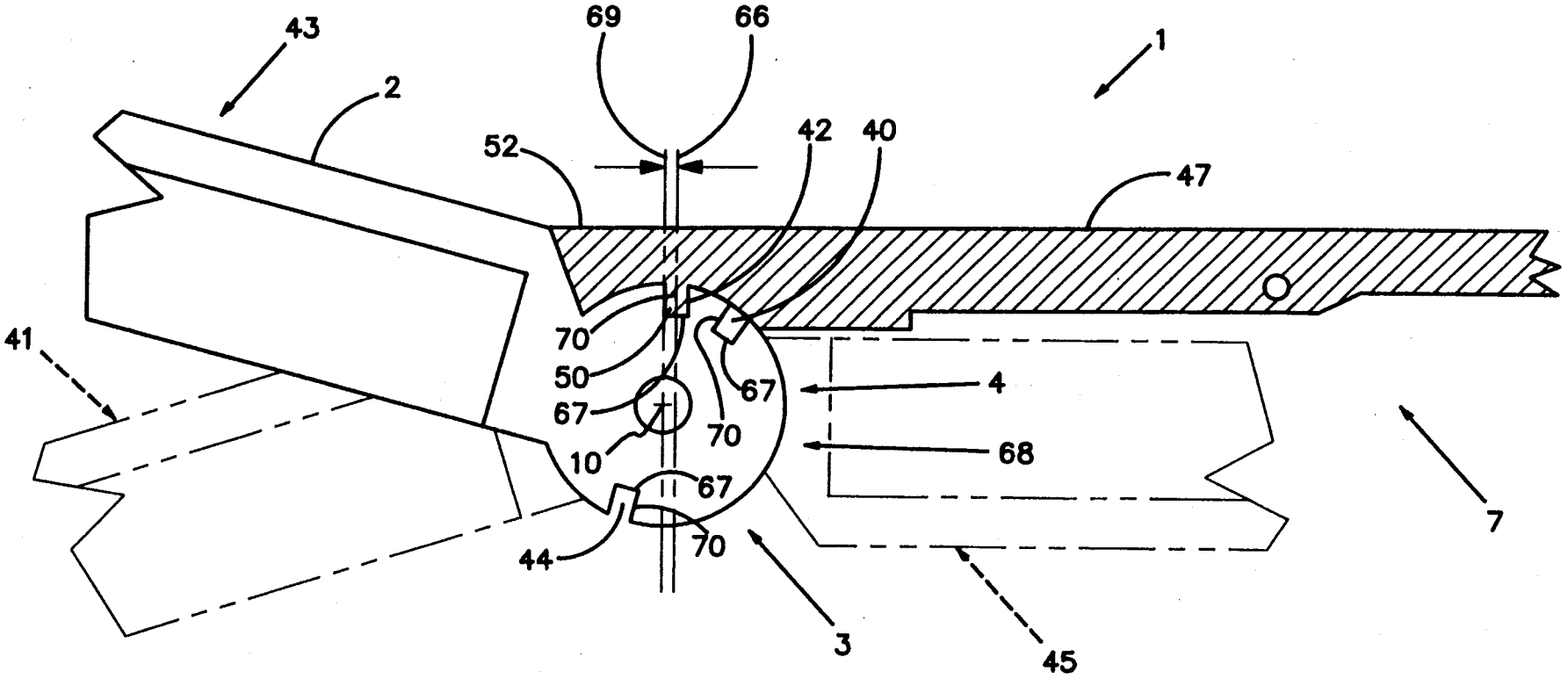
FIG. 7 is an enlarged sectional side view of an alternate folding embodiment of the invention shown in FIG. 5.

FIG. 7 depicts an alternate embodiment to the one shown in FIG. 5. Preferably, slots 40, 42, 44 are positioned such that the centerline 66 perpendicular to the base 67 of each slot crosses base portion 3 between pivot point 10 and base end 68. This position is illustrated at second slot 42 in FIG. 7. As shown, centerline 66 is offset from radius 69 (from pivot point 10) in the direction of base end 68. The positioning of slots 40,42,44 behind pivot point 10 helps to maintain blade 2 in the desired position. This is particularly important in first cutting position 41, in order to prevent blade 2 from slipping into second cutting position 43. Preferably, the forward wall 70 of each slot 40,42,44 coincides at least partially with a radius from pivot point 10. More preferably, the forward wall 70 of each slot 40,42,44 substantially coincides with a radius from pivot point 10. This position is illustrated at second slot 42 in FIG. 7, where forward wall 70 substantially coincides with radius 69. The other slots 40,44 are similarly positioned.

FIG. 6 depicts an embodiment of the invention 1 utilizing an axial locking member 54, which is slidably positioned in handle 7. Engagement tab 55 extends generally axially from locking member 54. Resilient means 11, preferably a spring 56, is interposed between a fixed point 57 on handle 7 and base end 37 of locking member 54. Engagement tab 55 is axially urged against outer edge 4 and into one of the slots 40,4:1,44 when aligned therewith. In the embodiment shown in FIG. 6, slots 40,42,44 are offset from pivot point 10, or substantially tangential with reference to pivot point 10, so as to be alignable with engagement tab 55. Of course, locking member 54 could be aligned with pivot point 10, allowing radial slots 40,42,44 to be used similar to those of FIG. 5, as well as other tab/slot configurations. Slide support 58, or other suitable means known in the art, provides support for locking member 54. Means 46 for retracting locking member 54 includes an actuator member 59 connected to and extending outward from locking member 54 to a point exterior of handle 7 through actuator slot 60.

Figure 8:
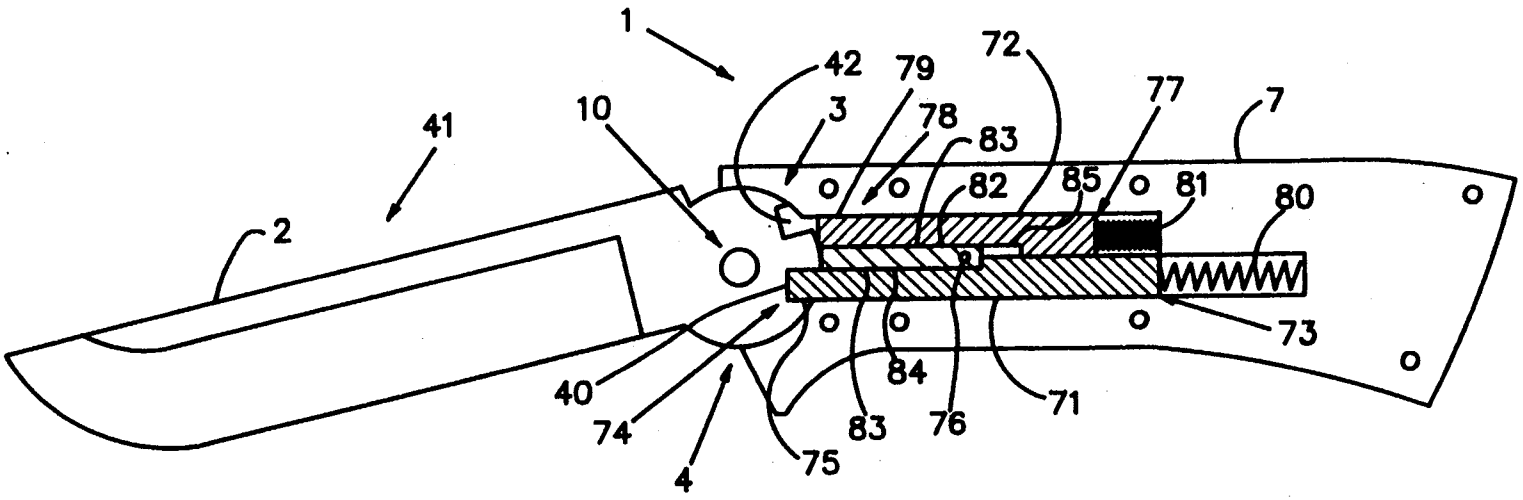
FIG. 8 is a sectional side view of an alternate embodiment of the invention shown in a first cutting position.
Figure 9:
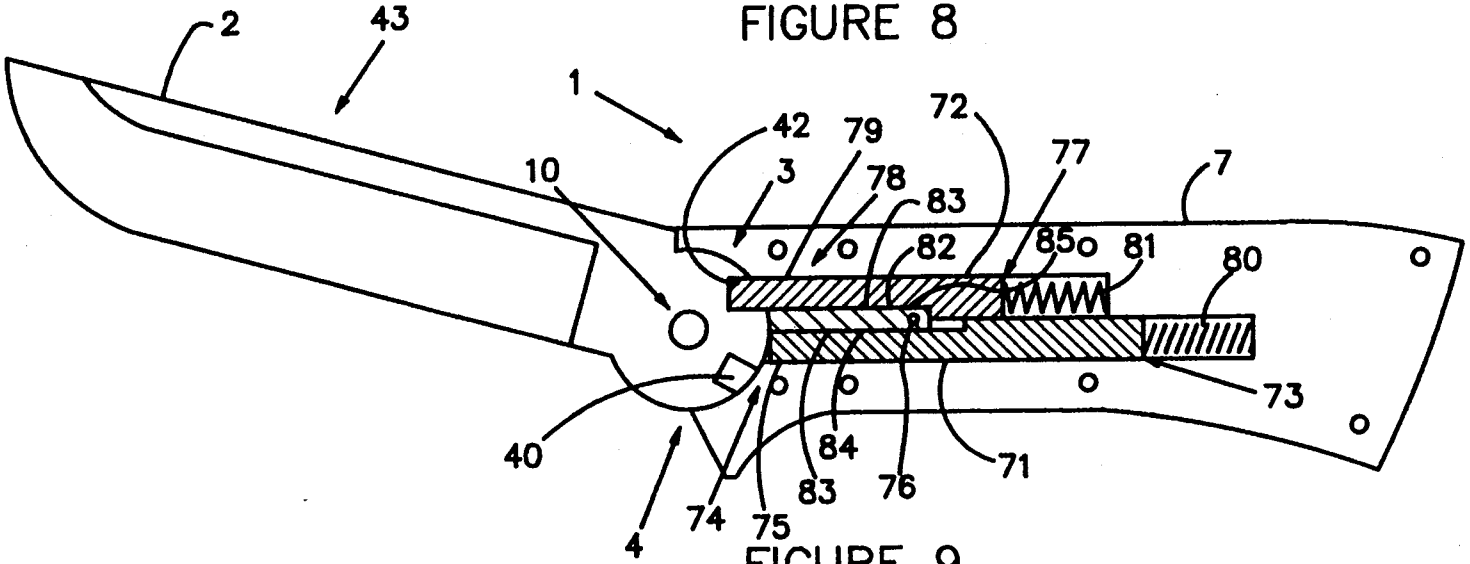
FIG. 9 is a sectional side view of an alternate embodiment of the invention shown in a second cutting position.

FIGS. 8 and 9 depict an alternate embodiment to that shown in FIG. 6. This embodiment utilizes a plurality of locking members 71,72. Locking members 71,72 are slidably positioned in handle 7 in a similar manner to that shown in FIG. 6. First locking member 71 has a base end 73, an engagement end 74 and an engagement tab 75 extending therefrom. Engagement tab 75 is matingly insertable in first slot 40 in first cutting position 41. Similarly, second locking member 72 has a base end 77, an engagement end 78 and an engagement tab 79 extending therefrom. Engagement tab 79 is matingly insertable in second slot 42 in second cutting position 43. Resilient means such as springs 80,81 bias locking members 71,72, respectively, against outer edge 4 of base portion 3 of blade 2. An actuator member 82 is operably connected to and extending outward from locking members 71,72 to a point exterior of handle 7. Although not shown in FIGS. 8 and 9, the portion of actuator member 82, such as an outwardly extending pin extending from pin hole 76, exterior of handle 7 may appear the same as actuator member 21 in FIG. 4. An actuator member 82 could be provided for each locking member 71,72. However, it is preferred that a single actuator member 82 be provided in an actuator recess 83 formed by opposing recesses 84,85 formed in locking members 71,72, respectively, as shown. In operation, engagement tab 75 of first locking member 71 is matingly inserted into first slot 40 in a first cutting position 41. To change cutting positions, actuator member 82 is retracted, retracting first locking member 71 and engagement tab 75 from first slot 40, and blade 2 is rotated until engagement tab 79 of second locking member 72 is aligned with and snaps into second slot 42 in second cutting position 43. To return to first cutting position 41 the process is simply reversed. The use of two locking members 71,72 allows for greater radial spacing between first slot 40 and second slot 42, even when there is a small angular deviation between first cutting position 41 and second cutting position 43.

As can be seen a versatile knife is provided which is easily adjustable between angular cutting positions without interchanging blades or removing hardware from the knife. The knife is adaptable to both folding and non-folding embodiments. Upon a review of the disclosure contained herein, other embodiments of the invention may occur to those skilled in the art, and such embodiments are intended to be included within the scope and spirit of the following claims.

I claim:

1. A knife having angularly adjustable cutting positions, comprising:

a. a blade having a base portion, said base portion having an outer edge including an engagement portion including a plurality of slots spaced apart on said outer edge of said base portion, said slots extending into said base portion;

b. a handle having a blade end, said handle including a plurality of locking members positioned in said handle, each said locking member having a base end, an engagement end and an engagement tab extending from said engagement end, said engagement tab of a first of said locking members being selectively and matingly insertable into a first of said slots in a first cutting position, and said engagement tab of a second of said locking members being selectively and matingly insertable into a second of said slots in a second cutting position, said locking members being positioned in said handle such that a resilient means is biased against each said locking member so as to urge said tab against said outer edge of said base portion and into one of said slots when aligned therewith, said handle further including a means for retracting said locking members against said resilient means and away from engagement with said outer edge so as to allow said blade to be pivoted between said cutting positions;

c. said resilient means for biasing said locking members against said outer edge of said base portion, said resilient means being interposed between a fixed point on said handle and said locking member; and wherein each said locking member is slidably positioned in said handle such that said tab extends generally axially from said locking member and is axially urged against said outer edge of said base portion of said blade and into one of said slots when aligned therewith; and wherein said base portion of said blade is pivotally attached to said blade end of said handle at a pivot point located within said base portion.

2. A knife according to claim 1, wherein said resilient means comprises a spring.

3. A knife according to claim 1, wherein said means for retracting said locking members includes an actuator member operably connected to and extending outward from said locking members to a point exterior of said handle.

4. A knife according to claim 3, wherein first and second said locking members are provided, said first and second locking members being positioned adjacent to each other and having opposing recesses forming an actuator recess, said actuator member being positioned in said actuator recess such that said actuator member will retract either said first or said second locking member when said tab of said first or said second locking member is positioned in one of said slots.

5. A knife having angularly adjustable cutting positions, comprising:

a. a blade having a base portion and a base end, said base portion having an outer edge including an engagement portion including a plurality of slots spaced apart on said outer edge of said base portion and extending into said base portion, each said slot having a base and a forward wall;

b. a handle having a blade end, said handle including a locking member positioned in said handle, said locking member having a base end, an engagement end and an engagement tab extending from said engagement end, said engagement tab being selectively and matingly insertable into a first of said slots in a first cutting position, and selectively and matingly insertable into a second of said slots in a second cutting position, said locking member being positioned in said handle such that a resilient means is biased against said locking member so as to urge said tab against said outer edge of said blade and into one of said slots when aligned therewith, said locking member further having a means for retracting said locking member against said resilient means and away from engagement with said outer edge so as to allow said blade to be pivoted between said cutting positions;

c. said resilient means for biasing said locking member against said outer edge of said blade, said resilient means being positioned in said handle; and wherein said base portion of said blade is pivotally attached to said blade end of said handle at a pivot point located within said base portion, and wherein said slots are located such that a centerline perpendicular to said base of each said slot when engaged with said tab crosses said base portion between said pivot point and said base end.

6. A knife according to claim 5, wherein at least three of said slots are provided, with said engagement tab being selectively and matingly insertable into a third of said slots in a closed position.

7. A knife according to claim 5, wherein said handle further includes a means, in operational connection with said second slot, for covering said second slot when said blade is fixed in said first cutting position.

8. A knife according to claim 7, wherein said means for covering said second slot comprises a tip portion extending from said engagement end of said locking member, said tip portion having sufficient dimensions to cover said second slot when said blade is fixed in said first cutting position.

9. A knife according to claim 7, wherein said forward wall of said first of said slots coincides at least partially with a radius from said pivot point.

10. A knife according to claim 9, wherein said forward wall of said first of said slots substantially coincides with a radius from said pivot point.

11. A knife according to claim 7, wherein said forward wall of said first and second of said slots coincides at least partially with a radius from said pivot point.

12. A knife according to claim 11, wherein said forward wall of said first and second of said slots substantially coincides with a radius from said pivot point.

13. A knife according to claim 5, wherein said resilient means is interposed between a fixed point on said handle and said base end of said locking member, and said locking member is pivotally attached to said handle such that said tab is pivotally urged against said outer edge of said blade and into one of said slots when aligned therewith.

14. A knife according to claim 13, wherein said means for retracting said locking member includes an exposed portion of said base end of said locking member exposed exterior of said handle so as to enable said base end of said locking member to be urged against said resilient means.

15. A knife according to claim 5, wherein said resilient means comprises a spring.

* * * * *